US009173514B2

(12) United States Patent
Takumah

(10) Patent No.: US 9,173,514 B2
(45) Date of Patent: Nov. 3, 2015

(54) ACCESSORY STRAWS FOR MIXING AND CONSUMING A BEVERAGE

(76) Inventor: Maluki C. Takumah, Atlanta, GA (US)

( * ) Notice: Subject to any disclaimer, the term of this patent is extended or adjusted under 35 U.S.C. 154(b) by 847 days.

(21) Appl. No.: 12/927,140

(22) Filed: Nov. 8, 2010

(65) Prior Publication Data

US 2011/0059216 A1 Mar. 10, 2011

Related U.S. Application Data

(63) Continuation-in-part of application No. 11/827,281, filed on Jul. 11, 2007, now abandoned.

(60) Provisional application No. 60/830,920, filed on Jul. 14, 2006.

(51) Int. Cl.

| | |
|---|---|
| ***A47G 21/18*** | (2006.01) |
| ***B01F 7/00*** | (2006.01) |
| ***B01F 13/00*** | (2006.01) |
| *B01F 15/00* | (2006.01) |

(52) U.S. Cl.

CPC ..... *A47G 21/18* (2013.01); *B01F 7/0005* (2013.01); *B01F 7/00183* (2013.01); *B01F 13/002* (2013.01); *B01F 15/00506* (2013.01); *B01F 2215/0026* (2013.01)

(58) Field of Classification Search

CPC ... A47G 21/18; B01F 7/0005; B01F 7/00183; B01F 13/002; B01F 15/00506; B01F 2215/0026

USPC ..... 366/129, 308; 239/33

See application file for complete search history.

(56) References Cited

U.S. PATENT DOCUMENTS

| | | | | |
|---|---|---|---|---|
| 612,349 | A | | 10/1898 | Kollenberg |
| 674,446 | A | * | 5/1901 | Marx ..... 30/141 |
| 697,579 | A | * | 4/1902 | Wehmeier et al. ..... 366/252 |
| 846,661 | A | | 3/1907 | Godward |
| 942,306 | A | * | 12/1909 | Clarke ..... 239/33 |
| 1,282,537 | A | | 10/1918 | Burkhart |
| 1,494,742 | A | | 5/1924 | Hills |
| 1,666,106 | A | | 4/1928 | Norman |
| 2,092,353 | A | * | 9/1937 | Kyseth et al. ..... 416/72 |
| 2,094,268 | A | | 9/1937 | Friedman |
| 2,334,535 | A | * | 11/1943 | Bandell ..... 30/123 |
| 2,452,923 | A | * | 11/1948 | Graff ..... 416/142 |
| 2,613,107 | A | * | 10/1952 | Hartnett ..... 239/33 |

(Continued)

FOREIGN PATENT DOCUMENTS

| | | |
|---|---|---|
| DE | 3731058 A1 | 4/1989 |
| DE | 4230761 A1 | 3/1994 |

(Continued)

OTHER PUBLICATIONS

Frederic D. Schwarz, "Grasping At Straws", Invention & Technology, Winter 2006, pp. 6-7.

(Continued)

*Primary Examiner* — Charles Cooley

(74) *Attorney, Agent, or Firm* — Baker, Donelson, Bearman, Caldwell & Berkowitz

(57) ABSTRACT

A multi-purpose accessory straw is provided for use with a container for a consumable beverage, in which the straw is at least partially hollow and has structure to mix the beverage and at least minimize separation of the beverage into component phases or layers.

12 Claims, 10 Drawing Sheets

(56) References Cited

U.S. PATENT DOCUMENTS

| | | | | | |
|---|---|---|---|---|---|
| 2,859,515 | A | * | 11/1958 | Kinman | 30/141 |
| 2,979,267 | A | * | 4/1961 | Miller | 239/33 |
| 3,037,219 | A | | 6/1962 | Webb | |
| 3,038,256 | A | * | 6/1962 | Mayer | 30/141 |
| 3,099,565 | A | * | 7/1963 | Neuhauser | 426/85 |
| 3,132,850 | A | * | 5/1964 | Puchalski | 366/308 |
| 3,315,405 | A | * | 4/1967 | Hoffer | 446/71 |
| 3,545,980 | A | * | 12/1970 | Stanger | 426/85 |
| 3,648,369 | A | * | 3/1972 | Frodsham | 30/141 |
| 3,776,458 | A | * | 12/1973 | Chunga, Sr. | 239/33 |
| 4,109,817 | A | | 8/1978 | Payne et al. | |
| 4,134,494 | A | * | 1/1979 | Wong | 206/216 |
| 4,403,709 | A | | 9/1983 | Meins et al. | |
| 4,408,690 | A | | 10/1983 | Ferrero | |
| 4,530,606 | A | | 7/1985 | Hopkins | |
| 4,717,016 | A | * | 1/1988 | Dalgleish | 206/0.5 |
| 4,726,518 | A | | 2/1988 | Martina et al. | |
| 5,054,631 | A | | 10/1991 | Robbins, III | |
| 5,114,074 | A | * | 5/1992 | Frauenthal et al. | 239/33 |
| 5,295,609 | A | | 3/1994 | Robbins, III | |
| 5,713,664 | A | | 2/1998 | Harilela | |
| 5,788,106 | A | | 8/1998 | Hotinski | |
| 6,042,018 | A | | 3/2000 | Weinstein | |
| 6,056,206 | A | * | 5/2000 | Whiton | 239/33 |
| 6,206,561 | B1 | | 3/2001 | Hefti | |
| D440,810 | S | | 4/2001 | Olson | |
| 6,247,837 | B1 | * | 6/2001 | Wardberg | 366/129 |
| 6,258,394 | B1 | * | 7/2001 | Hochstein et al. | |
| 6,375,092 | B1 | * | 4/2002 | Banach | 239/33 |
| D458,809 | S | | 6/2002 | Richardson et al. | |
| 6,427,928 | B1 | | 8/2002 | Hirota | |
| 6,463,662 | B1 | | 10/2002 | Coscia et al. | |
| 6,561,434 | B2 | * | 5/2003 | Kaplan | 239/33 |
| 6,676,032 | B2 | | 1/2004 | Banach | |
| 6,955,305 | B2 | | 10/2005 | Banach | |
| 7,044,631 | B2 | * | 5/2006 | Settele | 366/129 |
| 7,047,648 | B1 | | 5/2006 | LeBel et al. | |
| D532,242 | S | | 11/2006 | Aikens | |
| 7,441,940 | B2 | | 10/2008 | Vanek | |
| 7,584,900 | B2 | | 9/2009 | White et al. | |
| 7,591,219 | B2 | * | 9/2009 | Saha | 99/323 |
| D603,206 | S | | 11/2009 | Wallace | |
| 7,731,101 | B2 | * | 6/2010 | Fabrizio et al. | 239/33 |
| 7,849,785 | B1 | * | 12/2010 | Saha et al. | 99/323 |
| D638,244 | S | * | 5/2011 | Wallace | D7/300.2 |
| D655,121 | S | * | 3/2012 | Wallace | D7/300.2 |
| 8,485,453 | B2 | * | 7/2013 | Efremkin et al. | 239/33 |
| 2001/0028003 | A1 | * | 10/2001 | Katsukawa | 239/33 |
| 2002/0088870 | A1 | * | 7/2002 | Banach | 239/33 |
| 2002/0134850 | A1 | * | 9/2002 | Hollenberg | 239/33 |
| 2002/0185547 | A1 | | 12/2002 | Kaplan | |
| 2004/0076074 | A1 | * | 4/2004 | Shubeck | 366/129 |
| 2005/0088907 | A1 | | 4/2005 | Vanek | |
| 2005/0263006 | A1 | * | 12/2005 | Saha | 99/275 |
| 2007/0211562 | A1 | | 9/2007 | Pitsis | |
| 2008/0080299 | A1 | * | 4/2008 | Takumah | 366/129 |
| 2008/0128529 | A1 | * | 6/2008 | Fernandez | 239/33 |
| 2009/0140070 | A1 | | 6/2009 | Efremkin et al. | |
| 2009/0256000 | A1 | | 10/2009 | Wallace | |
| 2009/0314852 | A1 | * | 12/2009 | Fabrizio et al. | 239/33 |
| 2010/0015292 | A1 | * | 1/2010 | Saha | 426/80 |
| 2010/0092309 | A1 | * | 4/2010 | Hockemeier | 417/53 |
| 2011/0059216 | A1 | * | 3/2011 | Takumah | 426/519 |
| 2011/0062168 | A1 | * | 3/2011 | Chow et al. | 220/705 |
| 2012/0328741 | A1 | * | 12/2012 | Hannah et al. | 426/85 |
| 2013/0020402 | A1 | * | 1/2013 | Wallace | 239/33 |
| 2015/0173543 | A1 | * | 6/2015 | Lindenthal-Breier | |

FOREIGN PATENT DOCUMENTS

| | | | | |
|---|---|---|---|---|
| EP | 164303 | A2 | | 12/1985 |
| EP | 284735 | A1 | | 10/1988 |
| FR | 2611472 | A1 | | 9/1988 |
| FR | 2671332 | A1 | | 7/1992 |
| JP | 7-322947 | | * | 12/1995 |
| WO | WO 9103427 | A1 | | 3/1991 |

OTHER PUBLICATIONS

Martha Davidson, "A Flexible Mind", Invention & Technology, Winter 2006, pp. 55-56.

* cited by examiner

ACCESSORY STRAWS FOR MIXING AND CONSUMING A BEVERAGE

This application is a continuation-in-part of U.S. patent application Ser. No. 11/827,281, filed Jul. 11, 2007, now abandoned, which claims the benefit of U.S. Provisional Patent Application Ser. No. 60/830,920, filed Jul. 14, 2006.

TECHNICAL FIELD

The present invention relates to accessory straws. In a more specific aspect, this invention relates to accessory straws for use with containers of consumable beverages.

In this application, the following terms will be understood to have the indicated definitions:

- mixing—refers to the mixing (i.e., stirring) and pre-mixing of a consumable beverage.
- beverage—refers to any liquid intended for consumption by a person, such as alcoholic beverages, mixed drinks, soft drinks, powdered soft drinks, etc.
- consumable—refers to a beverage which is primarily intended for consumption by a person.
- accessory straw—a straw which provides or adds convenience or effectiveness to the enjoyment and consumption of a beverage.

BACKGROUND OF THE INVENTION

In today's society, beverages of many types are consumed by persons at an increasing rate. Alcoholic and non-alcoholic beverages are consumed at breakfast, lunch, dinner and at various times throughout the day. Beverages are consumed for many reasons, such as nourishment, thirst, societal, replacement of minerals and/or vitamins, etc.

Many beverages primarily consist of a single liquid phase, such as wine, beer, milk, etc. However, other beverages may contain more than one liquid phase, such as mixed drinks, coffee with cream and sugar, etc. In either case, the beverage should be mixed (i.e., stirred) at least occasionally for purposes of taste and enjoyment. This objective to mix is most evident after a multi-phase beverage is placed or poured into a container, such as a glass or cup, to prevent or at least minimize the separation of the beverage into component phases (or layers).

Additionally, many current beverage containers are one-piece, which means that the entire container may have to be destroyed if a crack develops in the container or if the container is broken. This, of course, leads to a certain amount of unrecoverable waste.

While accessories for beverage containers are currently available, such as straws, stirrers and swizzle sticks, the beverage-consuming public continues to look for new accessories which will enhance their enjoyment and consumption of beverages, especially multi-phase beverages.

Therefore, there is a need for new and effective accessory straws.

SUMMARY OF THE INVENTION

Briefly described, the present invention provides an accessory straw for use with containers of consumable beverages, in which the accessory straw provides or adds to the enjoyment of the beverage.

Accordingly, an object of this invention is to provide a much needed accessory straw for use with containers of consumable beverages.

Another object of this invention is to provide an accessory straw for use with containers of consumable beverages, wherein a beverage can be consumed through the accessory straw.

Another object of this invention is to provide an accessory straw for use with containers of consumable beverages, wherein the accessory straw can be used to stir or mix the beverage.

Another object of this invention is to provide an accessory straw for use with containers of consumable beverages, wherein the straw can be used to prevent or at least minimize separation of the beverage into component phases or layers.

Another object of this invention is to provide a process for stirring (i.e., mixing) of consumable beverages.

Another object of this invention is to provide a process for stirring or mixing a consumable beverage wherein separation of the beverage into component phases or layers is prevented or at least minimized.

These and other objects, features and advantages of this invention will become apparent from the following detailed description.

DETAILED DESCRIPTION OF THE INVENTION

Figure 1:
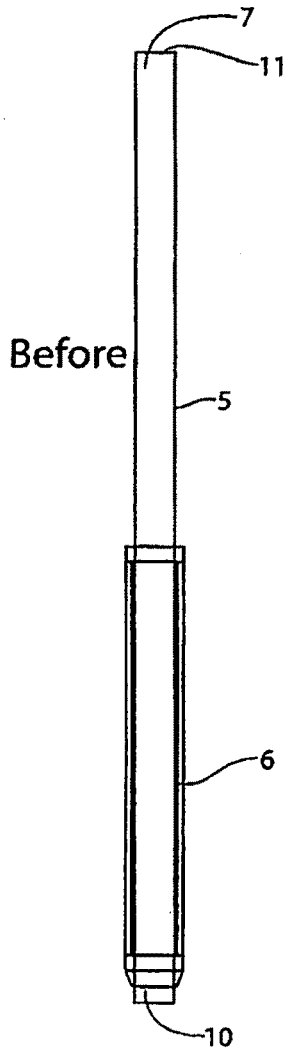
FIG. 1 is a view of an accessory straw according to this invention, shown in a closed or "before" position.

The present invention relates to an accessory straw for use with various types of containers of consumable beverages.

Preferred configurations of an accessory straw mixing device according to this invention are shown in the drawings of this application.

Referring now to the drawings, in which like numbers represent like elements, FIG. 1 shows an accessory straw 5 having a mixing means 6 including vanes shown in a closed position. In FIG. 1, straw 5 is an elongated tubular device having a hollow interior 7, an exposed top end 11 and an exposed bottom end 10.

Figure 2:
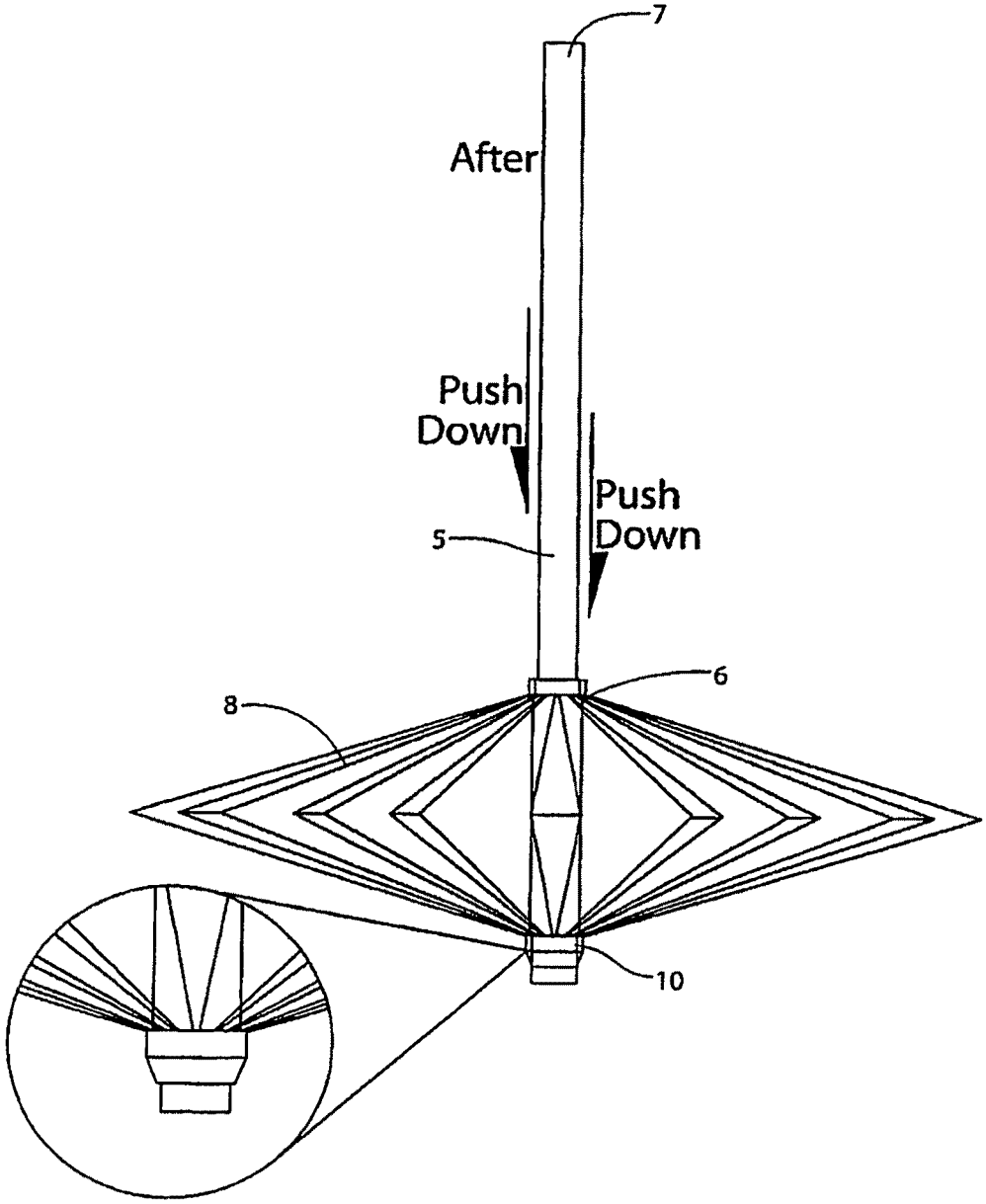
FIG. 2 is a view of an accessory straw according to this invention, shown in an open or "after" position, with an enlargement of a cutaway view of a base portion of the accessory straw.

FIG. 2 shows an accessory straw 5 in which the mixing means 6 is in an open or fluted position 8. FIG. 2 also shows an enlarged view of the exposed bottom end 10 of straw 5.

Figure 3:
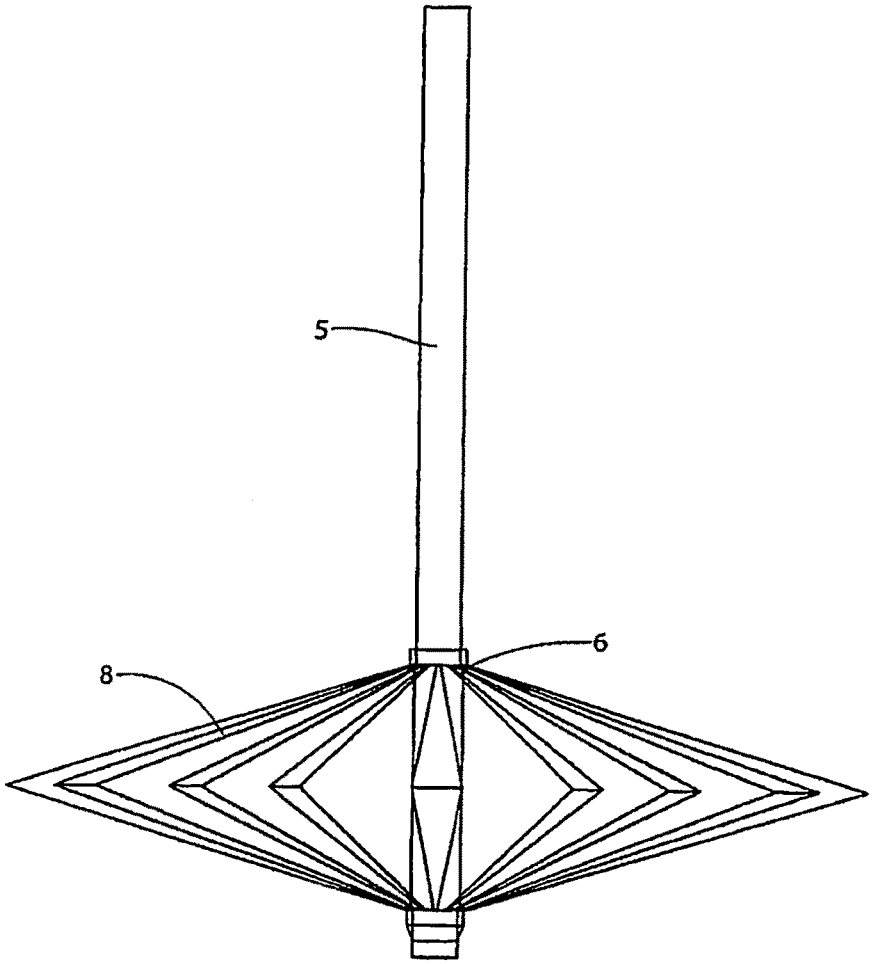
FIG. 3 is an enlarged view of the accessory straw shown in FIG. 2, shown in an open or "after" position.

FIG. 3 shows an enlarged view of the embodiment shown in FIG. 2, with straw 5 and mixing means 6 in an open or fluted position 8.

Figure 4:
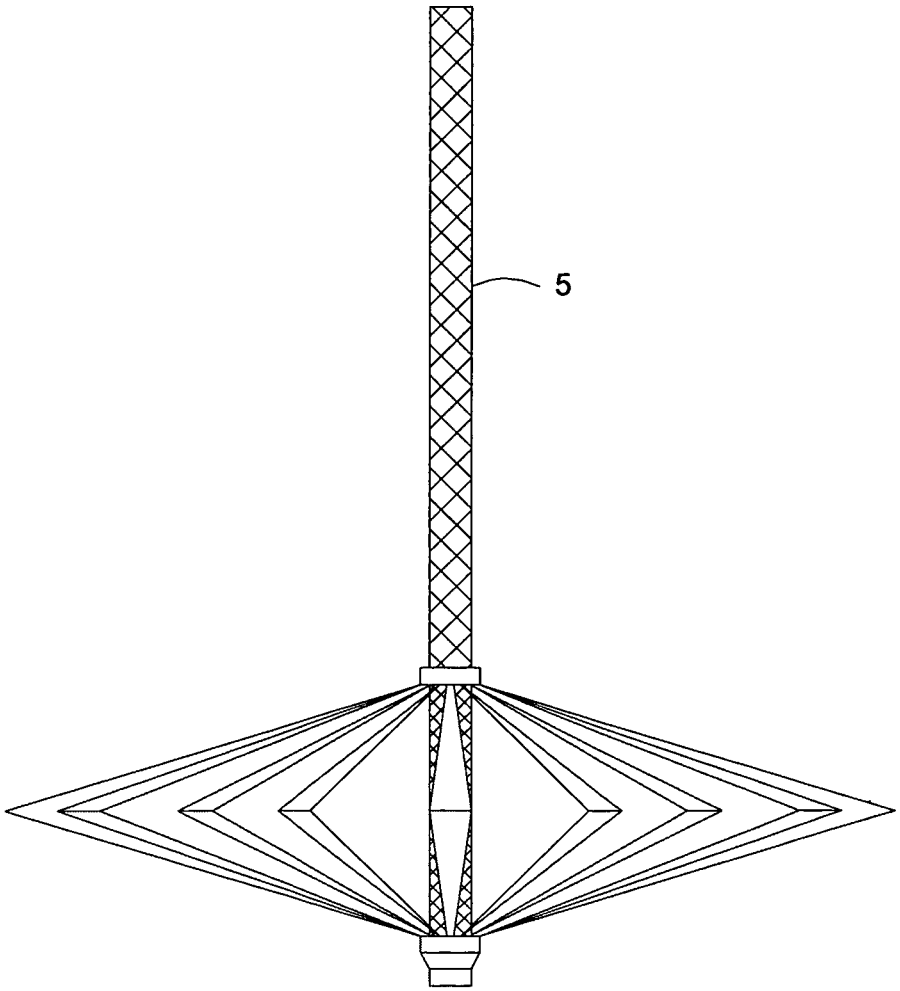
FIG. 4 is a view of an accessory straw according to this invention, with a design on the straw portion, shown in an open or "after" position.

FIG. 4 shows an enlarged view of the embodiment shown in FIG. 3, but with an ornamental design on an outside portion of straw 5.

Figure 5C:
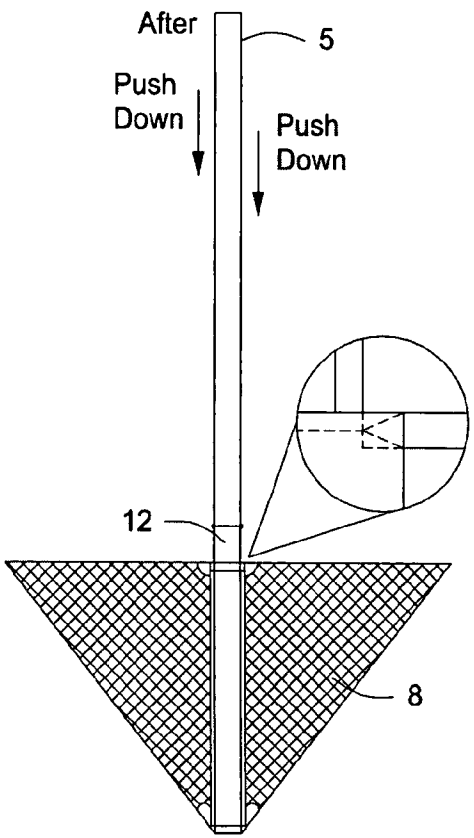
FIGS. 5A-5C are views of an accessory straw according to this invention, shown in the partially open, closed and open positions, with an enlargement of a cutaway view of a portion of the accessory straw.
Figure 5B:
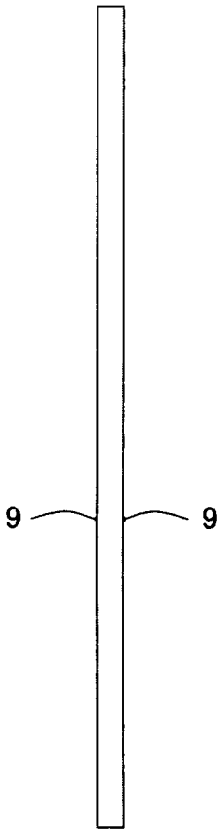
Figure 5A:
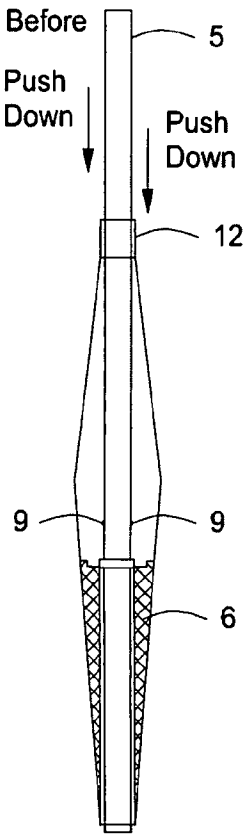
Figure 6C:
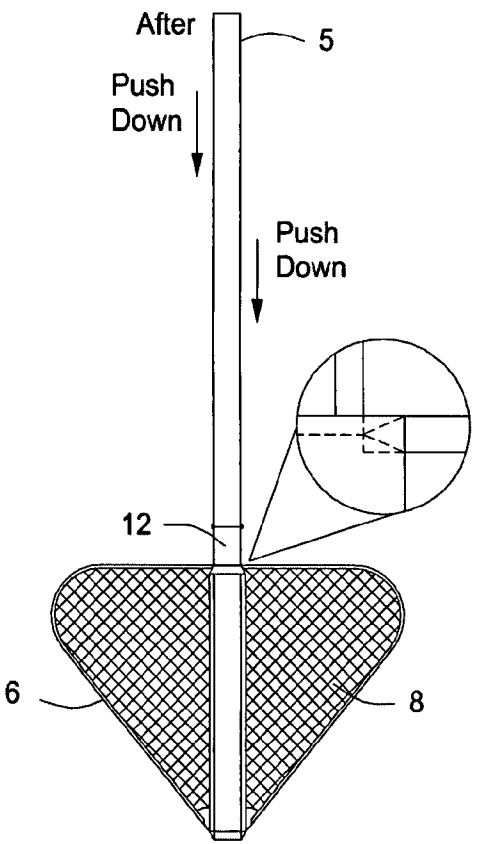
FIGS. 6A-6C are views of an accessory straw according to this invention, shown in the closed, partially open, and open positions, with an enlargement of a cutaway view of the accessory straw.

FIGS. 5A-5C show another embodiment of an accessory straw according to this invention. FIG. 5B shows a cross-sectional view of straw 5 with stops 9. FIG. 5A shows straw 5 with mixing means 6 in a partially closed position with stops 9 and gripping means 12 wherein the vanes are disposed adjacent the straw 5. FIG. 5C shows straw 5 with mixing means 6 in the open or fluted position 8. By using gripping means 12 and moving mixing means 6 in the direction shown by the arrows, mixing means 6 is moved to a predetermined point on the straw until stops 9 prevent further movement, and mixing means 6 is then in the open or fluted position. As shown in FIGS. 2, 3, 5C and 6C, in the open or fluted position 8, the vanes are bent to extend away from the straw 5 with the vanes forming an apex region furthermost spaced from the straw 5. In FIGS. 2, 3 and 5C, the apex region forms an edge between the upper and lower portions of the vanes. In this open of fluted position 8, the upper portion of the bent vanes can be oriented generally perpendicular to the straw 5 and the lower portion of the bent vanes can be oriented at an acute angle relative to the straw 5 as seen in the embodiment of FIGS. 5C and 6C.

Figure 6B:
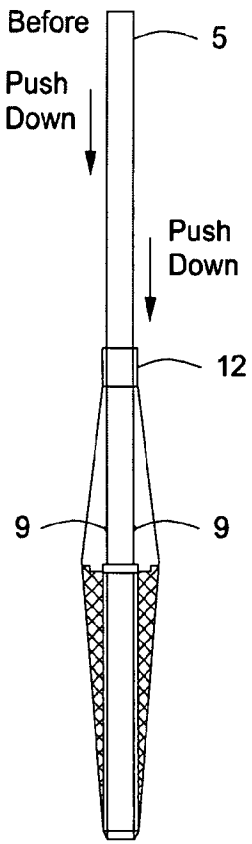
Figure 6A:
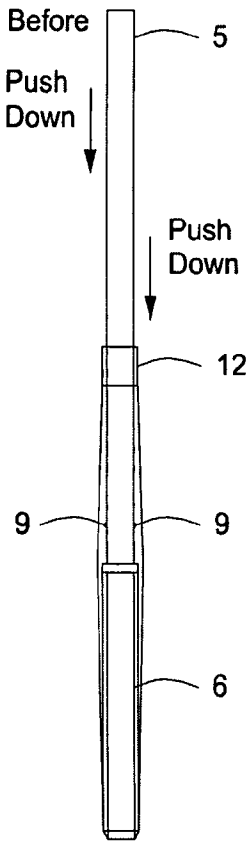

FIGS. 6A-6C show another embodiment of an accessory straw according to this invention. FIG. 6B shows a cross-sectional view of straw 5 in a partially open position with stops 9 and gripping means 12. FIG. 6A shows straw 5 with mixing means 6 in a closed position with stops 9 and gripping means 12. FIG. 6C shows straw 5 with mixing means 6 in the open or fluted position 8. By using gripping means 12 and moving mixing means 6 in the direction shown by the arrows, mixing means 6 is moved until stops 9 (not shown) prevent further movement, and mixing means 6 is then in an open or fluted position. In FIG. 6C, the apex region of the vanes forms a curved portion between the upper and lower portions of the vanes.

Figure 7A:
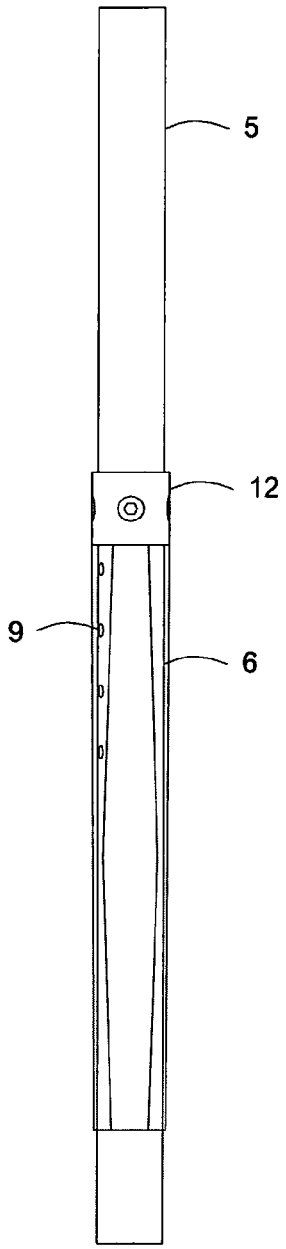
FIGS. 7A-7B are views of an accessory straw according to this invention, shown in the closed and open positions, and shown with notches as stops.
Figure 7B:
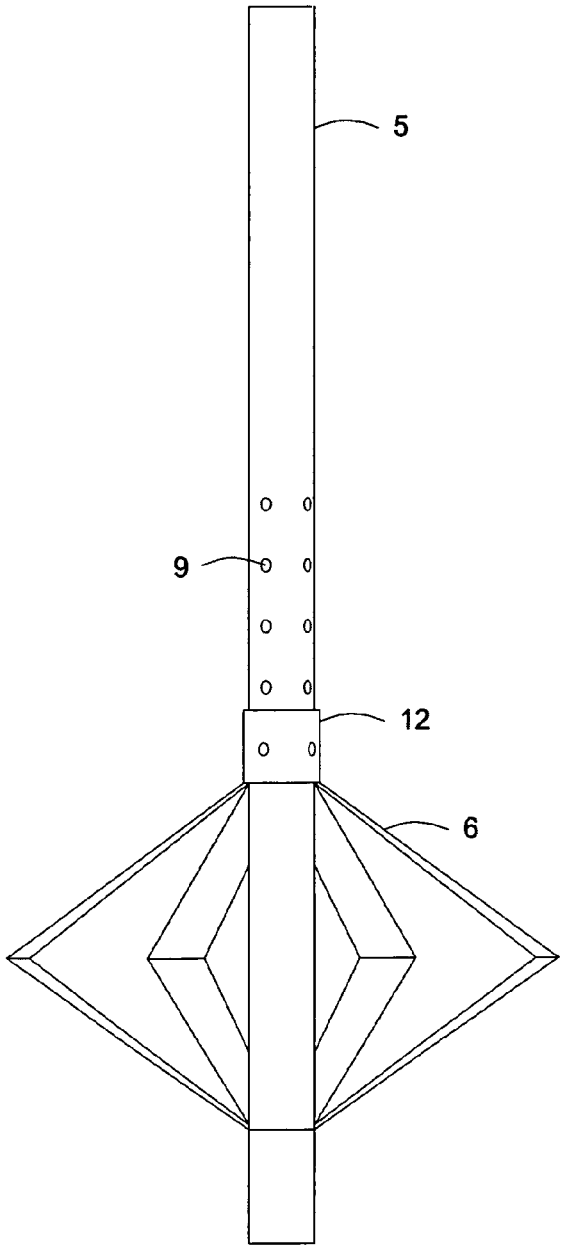

FIGS. 7A-7B show an embodiment of this invention with straw 5, mixing means 6 and gripping means 12. In FIGS. 7A and 7B, stops 9 are shown as notches. FIG. 7A shows straw 5 with mixing means 6 in the closed position. FIG. 7B shows straw 5 with mixing means 6 in the open or fluted position.

Figure 8A:
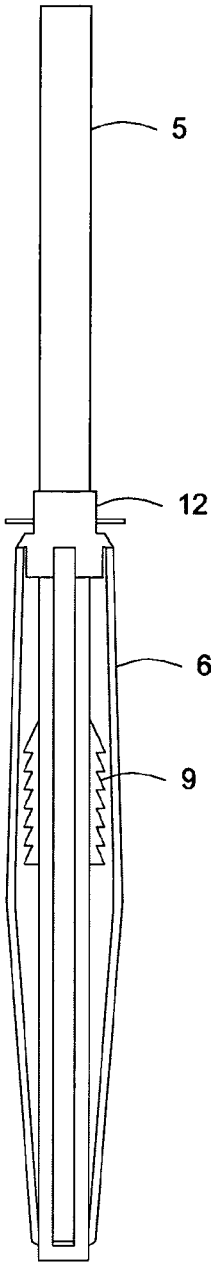
FIGS. 8A-8B are views of an accessory straw according to this invention, shown in the closed and open positions, and shown with an alternative configuration of the stops.
Figure 8B:
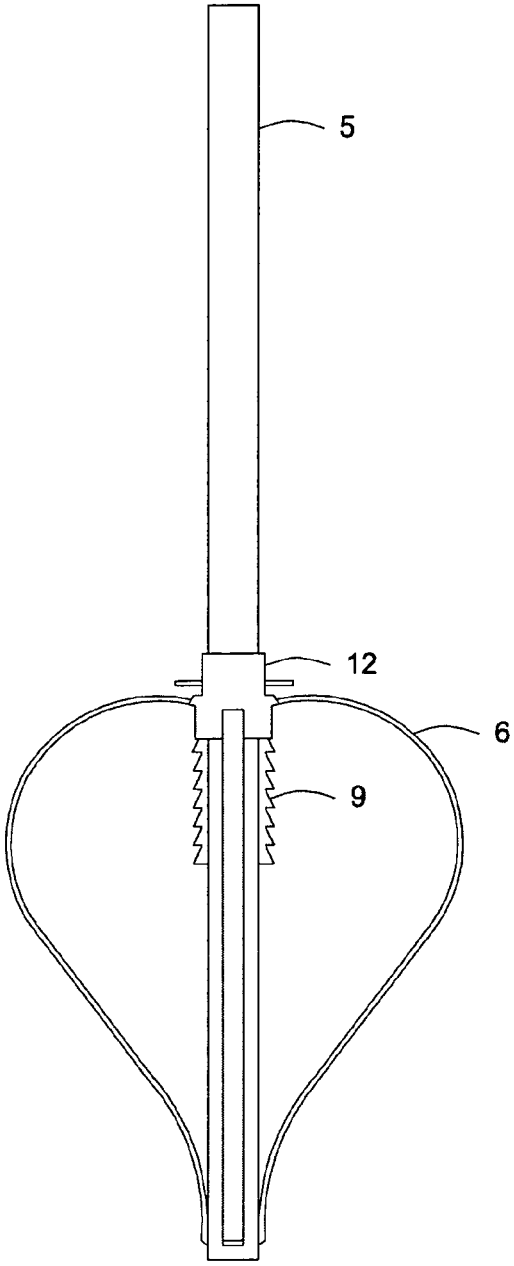

FIGS. 8A-8B show an embodiment of this invention with straw 5, mixing means 6 and gripping means 12. In FIGS. 8A and 8B, stops 9 are shown with an alternative configuration (inverted teeth) to that shown in FIGS. 7A and 7B. FIGS. 8A and 8B show straw 5 with mixing means 6 in the closed and open positions, respectively.

Figure 9A:
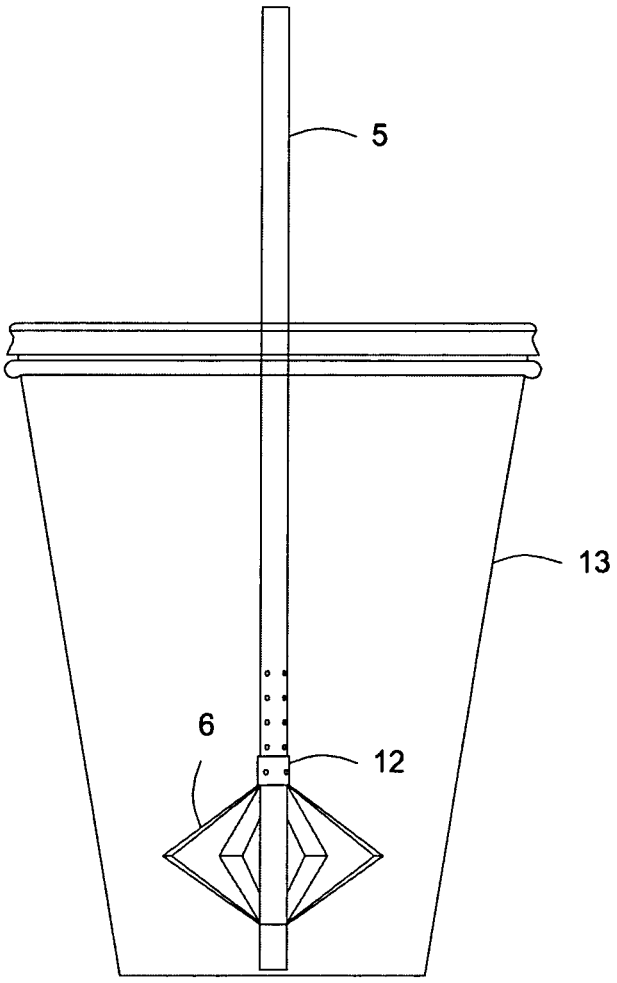
FIGS. 9A-9B are views of the accessory straw shown in FIGS. 7A-7B after insertion into a beverage container.
Figure 9B:
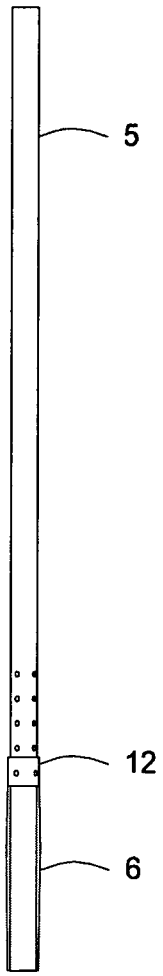

FIG. 9A shows the accessory straw 5 from FIG. 7B with mixing means 6 in the open or fluted position and gripping means 12 after insertion into a beverage container. FIG. 9B shows the accessory straw 5 from FIG. 7A with mixing means 6 and gripping means 12 in the closed position before insertion into a beverage container.

Figures 10A, 10B, 10C, 10D:
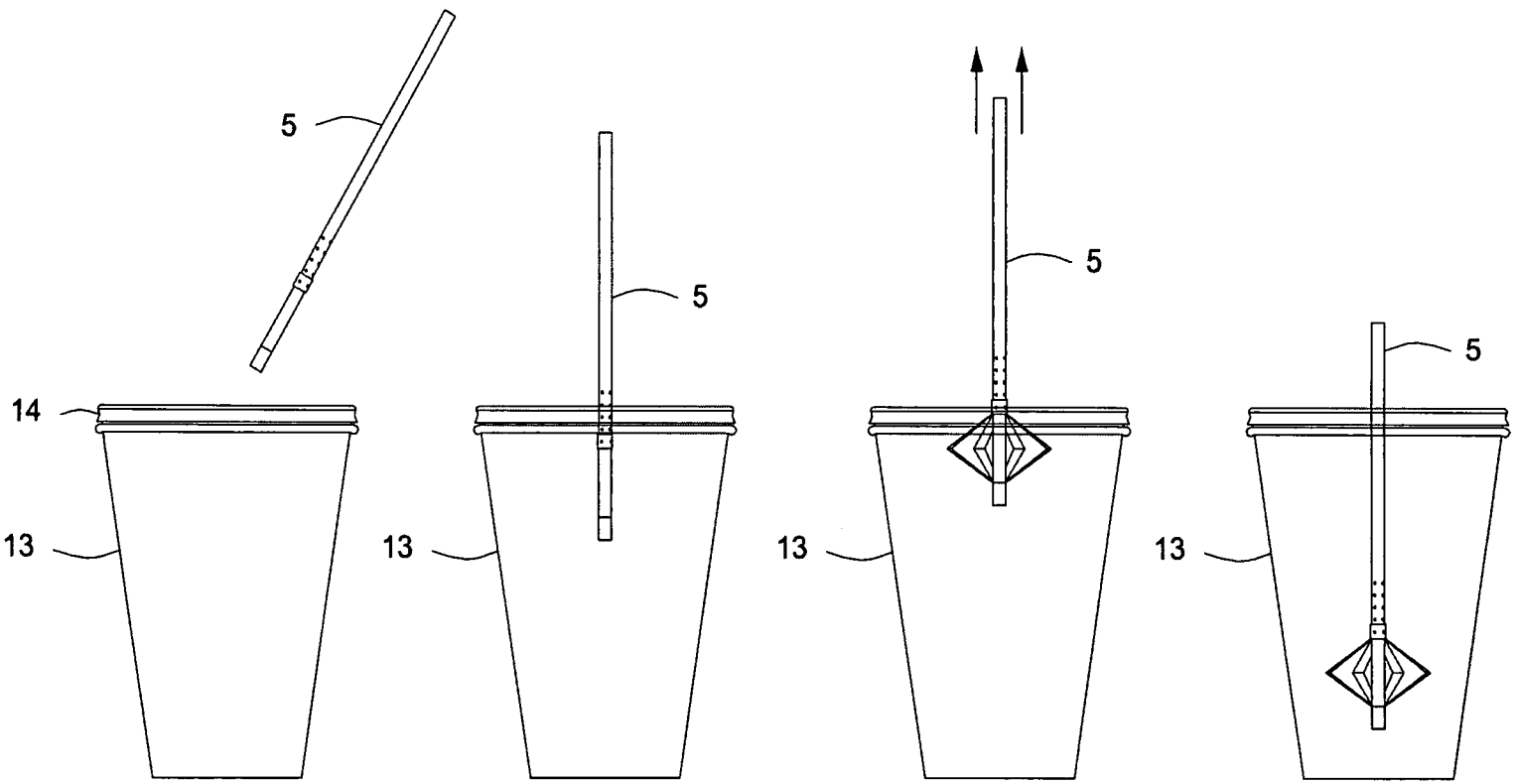
FIGS. 10A-10D show in four steps how the accessory straw of this invention can be used to stir and/or consume a beverage.

FIGS. 10A-10D show in four steps how the accessory straw of this invention can be used to stir and/or consume a beverage. In FIG. 10A, the beverage container 13 with a consumable beverage (not shown) is shown with the straw 5 in a closed position above the beverage container. In FIG. 10B, straw 5 has been inserted through an opening (not shown) in lid 14 for beverage container 13, with straw 5 still in a closed position. In FIG. 10C, straw 5 is positioned in beverage container 13 in the open or fluted position through use of gripping means 12 and stops 9. In FIG. 10D, straw 5 in the open or fluted position is shown after being further moved downwardly in beverage container 13. In FIGS. 10B, 10C and 10D, straw 5 can be used to consume the beverage. FIGS. 10C and 10D, straw 5 can be used to stir or mix the beverage.

In this invention, the accessory straw can have a hollow or at least partially hollow interior and can be made of various materials, such as stainless steel, polymeric materials such as polycarbonate, plastic materials, glass, etc., and can be of various lengths and widths. If the interior is hollow or at least partially hollow, the accessory straw can be used to stir, mix and consume a beverage.

The mixing means can be of any shape, such as vanes including blade or strip elements, and also can be of different sizes and numbers. To effectively function as part of the accessory straw, there must be a plurality (i.e., at least 2) of the mixing means.

The stops 9 can be of any configuration, such as the notches as shown in FIGS. 7A-7B or the inverted teeth configuration as shown in FIGS. 8A-8B. The stops 9 must mate or engage with an opposing element of the gripping means 12 so that the mixing means 6 can be in the preferred position (i.e. open or partially open) for the desired use.

In practice, the accessory straw of this invention is used to mix and/or consume a beverage. The accessory straw of this invention is equipped with a mechanism (i.e., mixing means 6) which can be opened by the user either with a downward or pushing motion or with an upward or pulling motion to form an open or fluted position. Once opened, the straw 5 can then be used to mix or stir the beverage and to prevent or at least minimize separation of the beverage into component phases or layers. The straw can also be used to consume the beverage if the interior of the straw is hollow or at least partially hollow.

This invention has been described with particular reference to certain embodiments, but variations and modifications can be made without departing from the spirit and scope of the invention.

The invention claimed is:

1. A mixing device comprising:

an elongated tubular device including an exposed top end and an exposed bottom end for consuming a beverage;

mixing means including vanes for mixing the beverage located on an outside portion of the tubular device and which are movable between a closed position wherein the vanes are disposed adjacent the tubular device and an open fluted position where the vanes are bent to extend away from the tubular device, the vanes forming an apex region furthermost spaced from the tubular device in the open fluted position;

gripping means located on the mixing means to enable a user to move the mixing means between the closed position and the open fluted position; and at least one stop element located on an outside portion of the tubular device cooperating with the gripping means to prevent movement of the mixing means beyond a predetermined point, the predetermined point orienting an upper portion of the bent vanes generally perpendicular to the tubular device and orienting a lower portion of the bent vanes at an acute angle relative to the tubular device.

2. A mixing device as defined by claim 1 wherein the tubular device is formed from a polymeric material.

3. A mixing device as defined by claim 2 wherein the polymeric material is selected from the group consisting of polycarbonate or plastic materials.

4. A mixing device as defined by claim 1 wherein the tubular device is formed from stainless steel or glass.

5. A mixing device as defined by claim 1 wherein the tubular device has a hollow interior.

6. A mixing device as defined by claim 1 wherein the tubular device has an at least partially hollow interior.

7. A mixing device as defined by claim 1 wherein the apex region forms an edge between the upper and lower portions of the vanes.

8. A mixing device as defined by claim 1 wherein the apex region forms a curved portion between the upper and lower portions of the vanes.

9. A mixing device as defined by claim 1 wherein the tubular device has an ornamental design on an outside portion thereof.

10. A mixing device as defined by claim 1 wherein the at least one stop element comprises a notch engaging with an opposing element on the gripping means.

11. A mixing device as defined by claim 1 wherein the at least one stop element comprises one or more inverted teeth engaging with an opposing element on the gripping means.

12. A mixing device as defined by claim 1 wherein the vanes include blades or strip elements.

* * * * *